US006173143B1

(12) United States Patent
Hirota et al.

(10) Patent No.: US 6,173,143 B1
(45) Date of Patent: Jan. 9, 2001

(54) CHARGED ROLLER TYPE ELECTROPHOTOGRAPHIC COPYING APPARATUS

(75) Inventors: Takayuki Hirota, Moriyama; Yasunori Ii, Kohnan, both of (JP)

(73) Assignee: Gunze Limited, Ayabe (JP)

( * ) Notice: Under 35 U.S.C. 154(b), the term of this patent shall be extended for 0 days.

(21) Appl. No.: 09/377,106

(22) Filed: Aug. 19, 1999

(30) Foreign Application Priority Data

Aug. 31, 1998 (JP) ..... 10-259103

(51) Int. Cl.[7] ..... G03G 15/02
(52) U.S. Cl. ..... 399/176; 361/225
(58) Field of Search ..... 399/168, 169, 399/174, 176, 115; 492/48; 361/212, 220, 221, 230, 225; 250/325, 326

(56) References Cited

U.S. PATENT DOCUMENTS 5,357,322 * 10/1994 Hoshika ..... 399/174
5,430,527 7/1995 Maruyama et al. ..... 399/176
5,534,344 * 7/1996 Kisu et al. ..... 361/221 X
5,557,372 * 9/1996 Ojima et al. ..... 399/174
5,619,311 4/1997 Kurokawa et al. ..... 399/176
5,666,608 9/1997 Christensen ..... 399/176

FOREIGN PATENT DOCUMENTS 6-36113 5/1994 (JP) .
6-130780 5/1994 (JP) .
7-49602 2/1995 (JP) .
9-26685 1/1997 (JP) .
9-230673 9/1997 (JP) .

* cited by examiner

*Primary Examiner*—William Royer
*Assistant Examiner*—Hoan Tran
(74) *Attorney, Agent, or Firm*—Armstrong, Westerman, Hattori, McLeland & Naughton

(57) ABSTRACT

A charged roller type electrophotographic copying apparatus capable of operating over a long term, in which durability of the apparatus is increased by bringing the charged roll into surface-contact with the photosensitive drum at low contact pressure will be supplied. In a charged roller type electrophotographic copying apparatus, the charged roller is endless tubular film of polyamide elastomer having a surface resistance value of $10^3$ to $10^{13}$ Ω/□, and is provided so as to come into surface-contact with a photoreceptor at its contact width therewith of 1.5 to 7 mm during copying.

6 Claims, 2 Drawing Sheets

CHARGED ROLLER TYPE ELECTROPHOTOGRAPHIC COPYING APPARATUS

BACKGROUND OF THE INVENTION

Detailed Description of the Invention

1. Technical Field of the Invention

The present invention relates to a charged roller type electrophotographic copying apparatus, and more particularly to its charged roller.

2. Prior Art

In an electrophotographic copying apparatus for copying/printing using toner conventionally used, the copying operation process is first started with an operation to charge a photoreceptor (generally drum-shaped), and in the case of performing the charging operation by atmospheric discharge, occurrence of ozone cannot be avoided, and this has posed a problem in terms of environmental pollution. As one of the solutions, there has been developed a charged roller type for charging by bringing a charged roller into contact with a photoreceptor to transfer the charge.

In the type for charging a photoreceptor using a charged roller, the photoreceptor is brought into contact with a cylindrical charged member, which has been charged, to thereby transfer the charge and charge the photoreceptor, and therefore, occurrence of ozone is restrained.

In a charged roller composed of this conventionally-used charging member structured into a cylindrical shape, there are two systems: film-shaped application system and brush-shaped application system as a typical application state of the charged member. When applied as the film-shaped system, semiconductive synthetic resin film is wound around/mounted to an aluminum tube (core body) through a conductive rubber layer when it is used (hereinafter referred to as film roll). On the other hand, when applied as the brush-shaped system, staple fiber of semiconductive synthetic fiber is uniformly electro-deposited on the outer periphery of the core body of an aluminum tube by the electrostatic flocking technique (so-called flocking method) (hereinafter, referred to as brush roll) when it is used.

In both the film roll system and brush roll system, however, no sufficiently satisfactory result was obtained because of the following problems:

That is, in the film roll system, it becomes difficult to maintain the uniformity in contact pressure between a photoreceptor and the film roll with an increase in the copying area (specially width), and as a result, charging spots tend to occur. Also, because of a mechanism in which rigid film rotationally contacts the photoreceptor structurally, the photoreceptor is easily worn out, and is easily damaged, and therefore, it has been designed to have such structure as to contact in a line contact state giving consideration to reducing the contact area as far as possible in order to avoid such a problem. However, this measure goes against it, the reduced contact width lowers the charging efficiency to cause a corona discharge-like charged state, and therefore, an effect of restraining the occurrence of ozone, which is the object, also deteriorates, and further, the risk of surface deterioration of the roll itself is also increased when higher voltage is applied. Therefore, design is compelled to be made by looking for common ground in the contact width, resulting in the difficulties that only an apparatus having insufficient functions and prone to cause image quality defects can be manufactured.

On the other hand, even in the brush roll system, in terms of selection of the optimum flexural hardness and size of fiber which forms the brush, and securing of an optimum, uniform filling length and uniformity of filling density, it is difficult to manufacture brushes in which all of the requirements meet the respective optimum states, and it is also difficult to look for the optimum charging conditions with an apparatus provided with such a charging device for setting and operating.

When the flexural hardness of filling fiber is too high or the rotating speed is too fast, the brush roll system suffered from problems in terms of service life of the apparatus and maintenance of uniform charging such as: the photoreceptor is easily damaged; falling-off of the filling fiber cannot be completely prevented; and it is difficult to secure exceedingly uniform filling density.

Further, in the contact at a cross-section of the foregoing fiber, the electric resistance of the fiber can be determined by the volume resistance value, but in the contact charging based on the volume resistance value, it is inferior in the stability of resistance. In other words, the resistance characteristics tend to vary by environmental changes or changes over time. This is presumed to be because in the case of conductive powder dispersed in the fiber, for example, carbon black, it might move inside rather than on the surface of the fiber to change the state of dispersion. In addition, image defects based on pinhole defects on the surface of the photoreceptor tend to occur including the foregoing two systems. Therefore, it is also necessary to strictly control so as to use a non-defective photoreceptor.

As new means for improving the two foregoing known charging means, the inventor et al of the present invention previously developed a method using polyamide elastomer for contact charging, filed an application for patent, and the method was disclosed in Japanese Patent Laid-Open Application No. 9-230673.

The technique disclosed in the invention is to select polyamide elastomer as material for charged roll, to disperse and knead a conductive agent, preferably carbon black to this material, to impart a volume resistance value of $10^3$ to $10^{12}$ Ω·cm to the elastomer, to cut this sheet to a predetermined size and to bring the cross-section into contact with the surface of the photoreceptor for charging it.

Problems to be Solved by the Invention

An electrophotographic copying apparatus according to the invention disclosed in the foregoing Japanese Published Unexamined Patent Application is excellent compared with conventional, known charged roller type electrophotographic copying apparatuses, is capable of eliminating many defects of the latter, and commercialization has already been attempted. In the durability test during the commercialization test stage, however, points to be further improved in the durability aspect were found, and it turned out that it is indispensable to solve them.

That is, at a point of time whereat 5,000 sheets have been copied, although there are few problems in practical use, faint streak-shaped density spots start to be seen in the copied/printed image. Further, on the $10{,}000^{th}$ sheet, toner adhered on the photoreceptor starts to be seen around the contact portion of the sheet although slightly, and the tip end portion of the sheet starts to enter a seemingly shaved state. This phenomenon is presumed to have appeared for the following reason: because of charging at the cross-section of a thin sheet in line contact, all charge are concentrated on the tip end whenever voltage is applied, whereby the dispersed state of carbon black at the tip end portion varies to cause fluctuation in the volume resistance value; and resin, which is the matrix, itself starts to deteriorate.

SUMMARY OF THE INVENTION

Thus, in order to solve this problem, the inventor et al. of the present inventor started studying the solutions on the basis of the technique disclosed in the Japanese Patent Laid-Open Application No. 9-230673, and found out that it would be possible to solve the problem by the following means, arriving at the present invention.

Means for Solving the Problems

That is, as a method for solving the problem, as specified in the claims of the present invention, ① A charged roller type electrophotographic copying apparatus is structured such that the charged roller is endless tubular film made of polyamide elastomer having a surface resistance value of $10^3$ to $10^{13}$ Ω/□, and is provided in such a manner as to be in surface-contact with a photoreceptor at its contact width therewith of 1.5 to 7 mm during copying, whereby it is possible to obtain an apparatus capable of stably copying in excellent image quality for a long period of time.

② Further, in claims 2 to 4, concrete examples of particularly preferred embodiments have been disclosed and presented in a charged roller type electrophotographic copying apparatus defined in claim 1. That is, (1) As regards claim 2, in place of the structure of the charged roller in the charged roller type electrophotographic copying apparatus defined in claim 1, it is defined that the structure is arranged by causing endless tubular film of polyamide elastomer to be hung down from a conductive roller composed of a metallic core roller wound with conductive foam.

(2) As regards claim 3, it is defined that a charged roller specified in claim 1 or 2 is composed of endless tubular film of polyamide elastomer containing 5 to 30 wt. % of carbon black.

(3) As regards claim 4, it is defined that the endless tubular film of polyamide elastomer for the charged roller specified in any of claims 1 to 3 is composed of polyether block amide elastomer mainly composed of segment consisting of nylon 12 segment and polyalkylene glycol.

More specifically, according to the present invention, in order to impart charge to the photosensitive drum without generating ozone, which is the problem in the mechanism of the conventional charged roller type electrophotographic copying apparatus, a mechanism, in which a rigid charged roller is pressed against the photosensitive drum in a line contact state to shift and transfer charge, was required. However, this mechanism caused the following various difficulties: wear and damage on the surface of the photosensitive drum; uneven/concentrated charge density at the end portion (joint) of the semiconductive sheet of the charged roll; charge spots caused by uneven contact pressure at the drum-roll contact portion; and the like. In order to eliminate these difficulties, there has been developed an apparatus having such a mechanism that the charged roll is constituted with flexible, endless tubular film having low flexural modulus, and compressive elasticity, its contact with the photosensitive drum is conducted by utilizing electrostatic forces of attraction caused by charging the endless tubular film constituting the charged roll, and the charged roll is brought into surface-contact with the photosensitive drum at low contact pressure. Thus, all the problems could be solved.

Furthermore, according to the present invention, as constituent material for the endless tubular film constituting the charged roll, which satisfies the foregoing functions, polyamide elastomer is selected, whereby, needless to say that the above-described mechanical performance requirements are satisfied, the electric performance required for the charged roll material can be satisfied at the highest level, thus enabling a charged roll type electrophotographic copying apparatus excellent in durability having high performance and high stability to be supplied.

Concretely, the conventional charged roller type electrophotographic copying apparatus has the structure shown in the schematic side cross-sectional view of FIG. 5.

That is, a photosensitive drum 21 and a charged roll 22 for transferring charge to the photosensitive drum to charge it (charge at +) are arranged in the layout shown so that the charged roll 22 is in contact with the surface of the photosensitive drum 21 at contact width of about 1 mm. The charged roll 22 uses an aluminum tube as the core material, the circumference of which is wound with conductive rubber, and the circumference of the rubber sheet is further wound with an insulating thin layer such as fluoroplastic. The charged roll 22 is connected to variable current power supply 23 through a voltmeter 24 with lead wire drawn out from the aluminum tube as the core material, is supplied with necessary voltage to be charged, and charge is transferred through the contact surface between the charged roll and the photosensitive drum to supply charge on the surface of the photosensitive drum for charging.

Next, an original to be copied is exposed by an exposure device 25, an image to be copied is focused on the photosensitive drum 21 to form an electrostatic latent image, toner is supplied from a developer unit 26 to the electrostatic latent image to change it into a toner sensible image, which is transferred onto a sheet 28 which is supplied from the transfer drum 27 opposing to obtain a copied sheet 29. After the termination of the copying, all the remaining charge are de-electrified by a de-electrifier 30, and the remaining toner is further removed by a toner cleaner 31 for cleaning to complete the copying process. The foregoing is a cycle, and charging is started again to repeat the copying process.

In order to eliminate the apparatus defects in this charged roller type electrophotographic copying apparatus having the conventional basic structure, the present invention imparts the following functions which could not be performed before by employing such means as defined in the claims.

① In order to prevent the photosensitive drum, which is extremely sensitive, is susceptible to damage, and requires high precision, from being damaged, and to make shift/transfer of charge performable at high efficiency, the semiconductive polymer constituting the surface charged body of the charged roll was changed from the conventional high-hardness synthetic resin film to endless tubular film of more flexible polyamide elastomer (polyether block amide elastomer) rich in compressive elasticity performance. Thus, the higher efficiency of shift/transfer of charge and prevention of damage/extended service life of the photosensitive drum were achieved.

② The charged roller is structured with endless tubular film such that no cut surface is not allowed to exist in the sheet constituting the surface layer of the charged roll, thus eliminating the possibility that high voltage applied causes all charge to be concentrated on the tip end of the sheet cut surface to change the dispersed state of carbon black at the tip end portion and to cause fluctuation in the volume resistance value, and the possibility that resin, which is the matrix, itself starts to deteriorate. In this way, we succeeded in maintaining the stable performance of the charged roll over a long term.

③ Since the charged roller is structured with endless tubular film of more flexible polyamide elastomer, rich in compressive elasticity performance, the endless tubular film for charging is attracted and brought into tight contact with the photosensitive drum at a predetermined width (so as to have surface-contact at contact width of 1.5 to 7 mm), when high voltage is applied to the charged roller, by electrostatic forces of attraction based on the charging, thus enabling shift/transfer of charge to the photosensitive drum at high efficiency to be performed.

④ The application of endless tubular film of polyamide elastomer (polyether block amide elastomer) to the charged roll does not satisfy, solely by itself, a surface resistance value required for the shift/transfer of charge from the charged roll to the photosensitive drum. Therefore, a conductive agent such as carbon black is added to the polyamide elastomer for kneading, whereby indispensable electric performance such as an optimum surface resistance value ($10^3$ to $10^{13}$ Ω/□) can be arbitrarily and easily imparted, thus enabling a high-performance charged roll capable of maintaining stable performance over a long term to be manufactured.

In the structure of the above-described apparatus, the particularly important significance of imparting a predetermined surface resistance value to the charged roll will be described. In the charged roll type electrophotographic copying apparatus, the surface resistance value is an indispensable requirement for shifting and transferring charge to the photosensitive drum very efficiently, quickly, and accurately to copy stably and in high image quality, and as a concrete preferred value, the surface resistance value is required to be within a range of $10^3$ to $10^{13}$ Ω/□.

This is because when the surface resistance value is lower than $10^3$ Ω/□, the charging density becomes lower and the density of the copied image (particularly solid portion) tends to become low. The cause is presumed to be because when the surface resistance value is low, the applied charge turns into current, and is prone to flow and disappear. When the surface resistance value is higher than $10^{13}$ Ω/□ on the contrary, the charging efficiency lowers, the surface of the endless tubular film enters a heated state, and further corona discharge occurs on the surface. These phenomena are presumed to be because all the applied voltage is not consumed for charging the photoreceptor, but it is gradually charged.

In the size (tube diameter, thickness, and width) of the foregoing endless tubular film, first the tube diameter and width differ depending upon the size of and how to mount the conductive roll substrate, in other words, whether it is used in a firmly fixed state by fitting into the roll substrate or in a hanging-down state from the roll substrate as shown as a preferred embodiment in the present invention. On the other hand, as regards the thickness, a thin one is preferable to a thick one in order to perform effective charging with stabler surface resistance, and it is preferable to charge with balanced setting in consideration of durability based on the strength of the film itself, mountability to the roll substrate, traveling stability, and further how to mount. To exemplify the thickness from such standpoints, the thickness of the endless tubular film constituting the charged roll can be 0.05 to about 1 mm, preferably 0.07 to 0.7 mm.

The charged roll and the photosensitive drum are provided with such a clearance between the charged roll and the photosensitive drum that a contact width in which the endless tubular film constituting the charged roll and the photosensitive drum come into surface-contact with each other is 1.5 to 7 mm, preferably 2 to 6 mm or more preferably 3 to 5 mm.

According to the present invention, it is dependent on the semiconductive polyamide elastomer endless tubular film having the foregoing characteristic properties, and not charging means in line contact (kiss-touch like) performed in the conventional charged roller, that charging is performed in a surface-contact state. It is not until the contact width is regarded as one of the essential conditions that the charging can be attained still more effectively. This is because, in the present invention, it is also an object to exhibit an even better effect even in durability (wear of the film itself, fluctuated surface resistance value—image deterioration based on surface deterioration caused by wear) in addition to the charging efficiency. In order to exhibit the both effects simultaneously, it becomes necessary to also specify the contact width. When the width is under 1.5 mm, the charging efficiency tends to decrease, and ozone also tends to occur. When 7 mm is exceeded on the contrary, the durability tends to decrease although the charging efficiency does not decrease. Also, the surface-contact is likely to become uneven in the contact rotation with the photoreceptor, and this must be avoided.

Since the foregoing surface-contact width can be provided at least during copying, the charged roll can be arranged in surface-contact with the photoreceptor before copying, and can also be arranged spaced apart by some clearance from the surface of the photoreceptor.

In this way, when the contact width is smaller than the above-described designation, the efficiency decreases in terms of shift/transfer of charge, and when it is too large, problems may occur in terms of traveling stability and durability.

Application of such constituent conditions of the present invention makes it possible to obtain a high-performance charged roller type electrophotographic copying apparatus capable of maintaining excellent functions over a long term.

In the present invention, in place of the foregoing conventional charged roller, the roller is specified as described above. A polyamide elastomer endless tubular film having a surface resistance value of $10^3$ to $10^{13}$ Ω/□, preferably $10^5$ to $10^{11}$ Ω/□, more preferably $10^6$ to $10^9$ Ω/□, which forms the basis of the roller, is as described below.

Polyamide elastomer, which is the material, is different from various thermoplastic resins including a nylon resin having non-rubber-like elasticity and high hardness (about 60 or more in Shore D hardness), and is a non-vulcanized polyamide rubber elastic resin having low hardness (about 45 or more in Shore A hardness, about 60 or less in Shore D hardness) and thermal plasticity, obtained by imparting rubber-like elasticity to the nylon resin by a chemical method. However, the rubber elasticity of the elastomer is within the range of the deformation of elastic after-effect, being different from that close to such ideal elastic deformation as seen in natural rubber and synthetic rubber.

Polyamide elastomer (polyether block amide) is thermal plastic elastomer (TPE) composed of polyamide as hard segment, and polyalkylene glycol as soft segment, and is block copolymer expressed in the following general formula:

That is, $$—[—(Ny)—NHCO—R_1—CONH—(R_2O)n—]m—$$

Ny: polyamide segment, $R_1$, $R_2$: alkylene group.

The hard segment component is generally composed of aliphatic polyamide or aromatic polyamide components such as nylon 6, 66, 610, 11 and 12, and the soft segment is composed of such soft components showing entropy elasticity, for example, aliphatic polyether or aliphatic polyester components. Since various combinations are made by each of these segment components, it is possible to thereby replace the rubber elasticity or vary the hardness. Also, as an attempt of making it more flexible, in aliphatic polyamide of, for example, a hard segment component, its amide group may be alkylolated like methylolation, ethylolation and putylolation by causing alkylene oxide such as formaldehyde, ethylene oxide and propylene oxide to react.

The problem of the present invention can be attained with combinations with any of the foregoing components as long as they are polyamide elastomer in the present invention, and therefore, those which fall under the category of aliphatic polyamide ether elastomer obtained by a combination of an aliphatic polyamide component and an aliphatic polyether component among them although not specified exhibit an improved effect. Further, concerning an aliphatic polyamide component, which forms a hard segment portion, when this is specified as a polyamide 12 (nylon 12) segment, a further improvement effect can be seen. More specifically, when polyamide 12 is used as a segment, endless tubular film having stabler electric resistance characteristics is obtained, and this endless tubular film has various characteristic properties such as being excellent in durability (such as strength and dimensional resistance) and being hardly affected by environment (humidity and temperature).

In this respect, as regards the manufacturing method for polyamide elastomer, this is not limited at all because it is manufactured by a generally-known method. As the manufacturing method, according to a method in which polyamide 12, which is exemplified as a preferable one to the foregoing, is used as a hard segment, it is obtained by polymerizing mixture consisting of terminal amination polyalkylene ether glycol, aliphatic dicarboxylic acid of equivalent weight thereto, and ω-lauric lactam under the nylon type condition.

The foregoing polyamide elastomer has particularly a surface resistance value of $10^3$ to $10^{13}$ Ω/□ and a form of endless tubular film, and first the electric resistance characteristics are specified by the surface electric resistance when the photoreceptor is charged on the surface of the endless tubular film. Therefore, the electric resistance value of, at least, the surface layer portion necessitates a desired value to be stably maintained continuously. If polyamide elastomer is used as the material, stabler electric resistance characteristics, which cannot be obtained with other synthetic resins, can be exhibited. This maintenance of a stable surface resistance value for many hours enables copying at high image quality to be stably performed for a long period of time.

The significance of the foregoing surface resistance is as described previously, but the photoreceptor can be charged quickly and effectively only when the resistance value is within a range of $10^3$ to $10^{13}$ Ω/□. Polyamide elastomer having the foregoing surface resistance value has an endless tubular film shape, and is used in this shape as the charged roller, whereby the applied voltage for charging is not concentrated on one point throughout the charging operation, but uniform charging is continued at a predetermined width as compared with the foregoing charging system in the brush shape or sheet shape. As a result, stabler charging can be continuously maintained for a long time, and physical damage such as cracks is not caused on the surface. In other words, it is superior in durability.

Also, since there are no joints at all, it can be said to be more effective because there are no risks such as being cut by rotation, failure to smoothly rotate and charge irregularities caused.

Furthermore, even in the manufacture of the charged roll, it can be simply manufactured only by fitting the tubular film to the conductive roll substrate, and therefore, stable quality can always be obtained within a short time.

Next, the description will be made of the manufacturing method for polyamide elastomer endless tubular film having a surface resistance value of $10^3$ to $10^{13}$ Ω/□.

First, conductive powder of 5 to 30 wt. % (with respect to the polyamide elastomer powder), preferably 10 to 25 wt. % is mixed with the foregoing polyamide elastomer (pellet or powder) for dispersion. In this case, as regards means for dispersion, the most effective method for the elastomer and the conductive powder is employed, and it is preferable to mix them once with a high mixer or the like, thereafter to melt and knead for pelletizing with a biaxial extruder, and to supply this to the next molding machine for tubular film.

The conductive powder here is generally carbon series or metallic series which have a particle diameter of 1 to about 500 μm, and concretely, carbon black and carbon fiber can be exemplified in the carbon series, and aluminum, silver, copper, zinc oxide, tin indium and the like can be exemplified in the metallic series. In addition, titanic acid whisker and carbon whisker can also be exemplified.

For the foregoing conductive powder, the optimum one is further selected in consideration of mix-dispersion properties (compatibility) with polyamide elastomer, moldability, stability (electric resistance characteristics) after molding, and the like, and carbon black is preferable among them when selected in terms of these standpoints.

In this respect, there are various types of carbon black depending upon different raw material sources. These are acetylene black, channel black, furnace black, thermal black and the like, among which acetylene black or furnace black is more preferable.

Also, in this case of mixing, an effective one is selected from among generally-known various types of additives, and may be added by a small amount (so long as the essence of the present invention is not changed) for concurrent use.

The foregoing mixture (powder or pellet-like) obtained is supplied to an extruder with ring die (generally at 150 to 250° C.) for extrusion molding into endless-shaped tubular film. As regards molding conditions (temperature, discharge pressure, discharge speed, drawing, etc.), they may be experimentally determined, and detailed conditions can be determined by checking in advance particularly in consideration of their relation with variations in the surface resistance value.

In this respect, an electrophotographic copying apparatus according to the present invention copies not only in single color but also in multi-color, and exhibits similar operation effects for toner of each color.

After all, as the significance of selecting polyamide elastomer and its effect,

① The maximum requirement for the charged roll material is to be able to effectively shift and transfer the charge on the surface of the roll by causing the charged roll to come into tight contact with the photosensitive drum without causing any damage thereto. Therefore, the material must have such moderate hardness (Shore A hardness: 45 or more, Shore D hardness: 60 or less) as not to wear and damage the surface of the photosensitive drum, and such moderate flexural modulus (5,000 kgf/cm$^2$ or less) and compressive elasticity performance as to be able to closely contact uniformly. Polyamide elastomer is elastomer which satisfies these conditions, and since the physical properties such as compressive elasticity performance and hardness can be further changed because of its copolymer composition, it is possible to effectively cope with the requirement by selecting copolymer having copolymer composition suitable for the object.

② Since it is a roll for shifting and transferring charge onto the photosensitive drum, the charged roll material must have excellent electric characteristics, and particularly a surface resistance value ($10^3$ to $10^{13}$ Ω/□, further preferably $10^6$ to $10^9$ Ω/□) which becomes indispensable for transferring charge. Polyamide elastomer is polymer which falls under the category in which such electric characteristics are satisfied. Further, by adding 5 to 30 wt. % of conductive fine powder such as carbon black (acetylene black, channel black, thermal black, etc.), various metallic fine powder and titanic acid whisker to the polyamide elastomer for kneading, polyamide elastomer having any desired, optimum electric characteristics can be adjusted and manufactured. Since the kneading technique has been already established as general-purpose technique, this is the optimum material (polymer) from this standpoint in order to achieve the object.

③ Polyamide elastomer is one of thermoplastic elastomer (TPE) as described previously, and can be extrusion molded/injection molded into a molded product having an arbitrary shape by any of the existing general-purpose equipment. The extrusion molding technique for tube-like products having an arbitrary thickness and an arbitrary bore for manufacturing endless tubular film, which is one of the constituent conditions of the present invention, has already been established as general-purpose technique. Therefore, this polyamide elastomer has an advantage that desired, uniform endless tubular film having arbitrary thickness/bore can be manufactured very easily.

④ As previously described, the property of polyamide elastomer can be modified by selecting the copolymer composition (ingredient) of the block copolymer. Generally, by use of a constituent monomer unit having long chain length irrespective of hard segment or soft segment, the polyamide elastomer has an advantage that polymer suitable for the object can be arbitrarily selected by appropriately selecting the copolymer composition because it is known that polymer having lower hardness/rigidity/and coefficient of elasticity can be obtained by introduction of a side chain, and further that the elasticity performance can be changed by each segment length/block copolymerization ratio for hard and soft.

In the embodiment according to the present invention, nylon 12 has been selected as a hard segment in terms of correct flexibility of electric characteristics, but the present invention is not limited thereto.

DETAILED DESCRIPTION OF PREFERRED EMBODIMENTS

Embodiments of the Invention

The description will be made of a concrete apparatus specification for a charged roller type electrophotographic copying apparatus according to the present invention.

Figure 1:
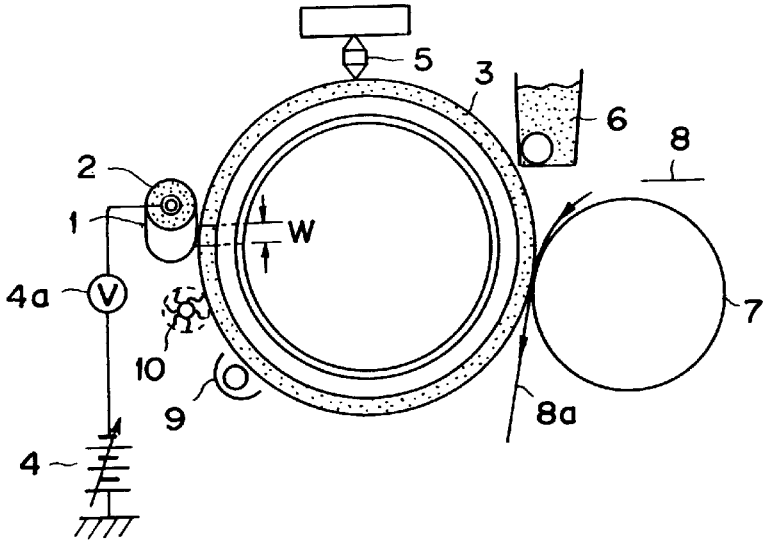
FIG. 1 is a schematic side cross-sectional view showing a charged roller type electrophotographic copying apparatus according to the present invention, particularly the form of the charged roller and its layout with respect to the photoreceptor.

In FIG. 1, the reference numeral 2 designates a conductive rubber sponge roll having an aluminum tube as a core body, and polyamide elastomer endless tubular film 1 having a surface resistance value of $10^3$ to $10^{13}$ Ω/□ according to the present invention is hung down from the conductive rubber sponge roll, and mounted thereto to constitute a charged roll. The charged roll is arranged to face a photosensitive drum 3. The tubular film 1 is not in contact (slight clearance) with the photosensitive drum 3. When application of predetermined voltage is started by a variable DC power supply 4 in order to charge the photosensitive drum 3, the tubular film 1, which is hanging down, is attracted by the photosensitive drum 3 in surface-contact (W=1.5 to 7 mm) to charge (+ charge). The tubular film 1 maintains this surface-contact width, and is linked with the rotation of the photosensitive drum 3 to charge while rotating together with the conductive rubber sponge roll 2 (although this generally rotates freely, an automatic rotating mechanism can be provided in synchronization with the photosensitive drum 3). When predetermined copying is terminated and applied voltage is stopped, the tubular film 1 leaves to return to the original position. The terminal of lead wire from the power supply 4 is connected to an electrode provided on the side of the aluminum tube as the core body through a voltmeter 4*a*. In this respect, reference numerals 5, 6, 7, 8 (8*a*), 9 and 10 designate an exposure device, a developer unit, a transfer drum, copying paper, a de-electrifier and toner cleaner correspondingly to FIG. 2 respectively.

Figure 2:
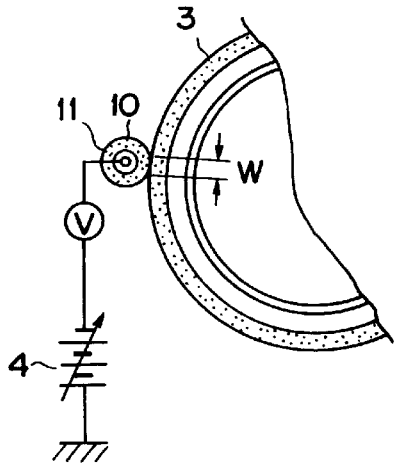
FIG. 2 is a partial side cross-sectional view showing the form of the charged roller and another layout with respect to the photoreceptor.
Figure 3:
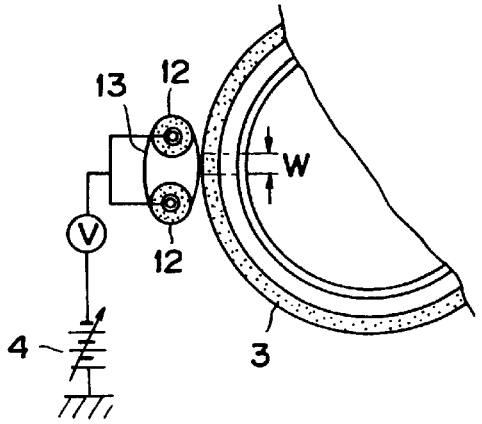
FIG. 3 is a partial side cross-sectional view showing the form of the charged roller and still another layout with respect to the photoreceptor.
Figure 4:
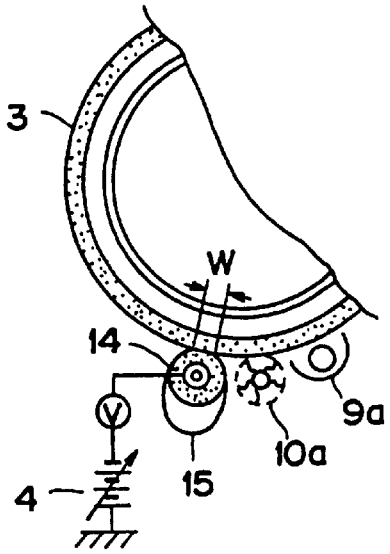
FIG. 4 is a partial side cross-sectional view showing the form of the charged roller and still another layout with respect to the photoreceptor.
Figure 5:
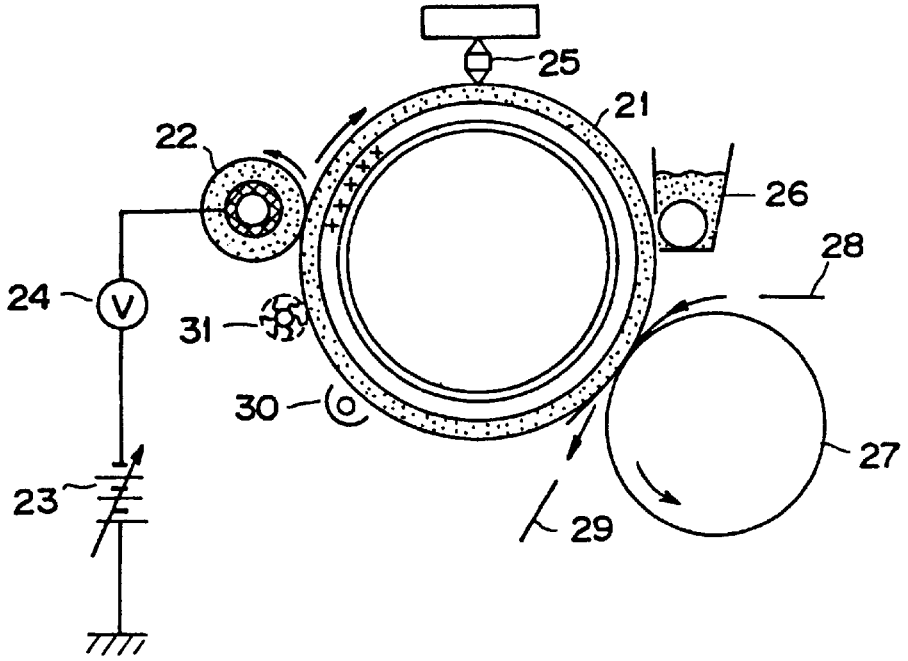
FIG5 PRIOR ART
FIG. 5 is a partial side cross-sectional view showing the conventional charged roller type electrophotographic copying apparatus.

FIGS. 2 to 4 show other examples of the arrangement state in the partial view of FIG. 1.

In other words, FIG. 2 shows a case where a charged roll 11 using the foregoing endless tubular film is physically pressed against a conductive rubber sponge roll 10, for arrangement, manufactured in accordance with the foregoing structure before charging is started so that the charged roll in a fitted and fixed state has a predetermined surface-contact width (W).

After setting at a predetermined width, voltage is applied to charge the photosensitive drum 3 through the charged roll 11. The rotation of the photosensitive drum causes the charged roll to rotate in synchronization so that it continues to charge at a constant charging potential during copying.

In this respect, the charged roll may freely rotate or may have an automatic synchronizing rotating mechanism with the photosensitive drum. Also, it is preferable to provide the photosensitive drum with a mounting/demounting mechanism in terms of contact width adjustment.

FIG. 3 shows one form of application of the foregoing FIG. 1, and this is a case where two conductive rubber sponge rolls 12, 12 are vertically provided in vertical positions, and the foregoing endless tubular film 13 is tensioned around those two conductive rubber sponge rolls like a belt to constitute a belt-like charged roll, and the belt-like charged roll is arranged to face the photosensitive drum 3 with slight clearance created therebetween.

The slight clearance here is such a distance that the endless tubular film 13 can be easily attracted onto the surface of the photosensitive drum 3 by electrostatic forces of attraction generated by applied voltage as in the case of the foregoing FIG. 1. As regards the concrete numerical value, it depends upon, for example, the thickness (suppleness) of the endless tubular film 13, the surface resistance value, applied voltage and the like, and therefore, these relations should be checked in advance to determine them, and the numerical value cannot be uniquely exemplified.

In this respect, in FIG. 3, wiring has been made so that voltage is simultaneously applied to both of the conductive rubber sponge rolls 12, but the voltage may be applied to either.

Further, FIG. 4 shows a case where the foregoing endless tubular film 15 physically presses the charged roll hung down from the conductive rubber sponge roll 14 in such a state as shown in FIG. 1 against the photosensitive drum 3 at a predetermined surface-contact width (W) as shown in (1-B) before charging is started for arrangement.

The tubular film 15 is linked with the rotation of the photosensitive drum 3 together with the sponge roll 14, but the sponge roll 14 at this time takes either free rotation or automatic synchronizing rotation mechanism with the photosensitive drum 3. The photosensitive drum 3 is preferably provided with a mounting/demounting mechanism as in the case of FIG. 2.

In this respect, since the tubular film 15 is longer and can be freely fitted as compared with FIG. 2, this example is a preferred structural form in the respect.

In this respect, in FIG. 1, there is, as a preferred embodiment, exemplified a conductive roll substrate having the foregoing endless tubular film mounted in which an aluminum tube is used as the core body and is wound with a conductive rubber sponge, but another metallic tube may be used in place of this aluminum tube, and in place of the conductive rubber sponge, a conductive roll wound with a non-sponge conductive rubber sheet, conductive bonded fabric or felt, or composite material obtained by appropriately combining these materials may be used as the substrate roll. Also, as regards hardness of the foregoing materials used for winding, and hardness of the conductive roll substrate obtained by winding, generally 10 to about 50 can be exemplified in rubber hardness (Shore A), but the optimum conditions can be determined as a pretest presupposing a condition that it effectively contributes to the charging efficiency, durability and the like.

In the above-described embodiments, there has been exemplified an object comprising a conductive roll core body having endless tubular film mounted, wound with a conductive sponge with an aluminum tube as the core material, but it is not necessary to limit the core body of the roll to aluminum, and any conductive metallic tube can be used. Also, the conductive rubber sponge layer does not have to be of rubber sponge, but any material having compressive elasticity performance can be used so long as it is conductive. Any object comprising core material wound with conductive felt, conductive elastomer or the like can be used.

Embodiment

Hereinafter, with reference to embodiments, the description will be made of the technical content and implementation of the present invention further in detail.

First Embodiment

Polyether polyamide resin powder [produced by Ube Industries, Ltd. UBE PAE 1200S, M.P.: 157° C., specific gravity: 1.17, MFR: 6 to 13 (190° C.], which has been absolutely dried using nylon 12 as a hard segment, and 24 wt. % of acetylene black are mixed with each other, and this mixture is kneaded using a biaxial kneading extruder to manufacture a pellet made of polyether polyamide resin blended with a conductive agent.

Next, the pellet thus obtained is dried, is subjected to inner sizing at extrusion temperature of 160° C. and at take-off speed of 1.2 m/minute using a single extruder mounted with ring die for tube extrusion molding with slit width of 1.5 mm, and is taken off so as not to positively draw while being air-cooled to manufacture tube of polyether amide.

The polyether amide tube obtained was tubular film (tube) having a very uniform and flat surface state with thickness of $100\pm5\mu$ and outside diameter of 10 mmϕ.

This tube was cut into a length of 350 mm and its resistance value was $2(\pm0.2)\times10^7$ Ω/□ when the surface resistance value was measured, and the tube had a stable and uniform resistance value in which no actual difference could be found even if the applied voltage was changed, and even if the measuring place was changed.

Using this tube, such a charged roller type electrophotographic copying apparatus as shown in FIG. 1 was manufactured.

More specifically, the tube manufactured (hereinafter, referred to as tube 1) was cut into a length of 330 mm, and was inserted into a conductive sponge rubber roll (surface hardness Shore A10) having an outside diameter of 7 mmϕ and a length of 330 mm wound with conductive sponge rubber on the outer periphery thereof with an aluminum tube as the core material to manufacture a charged roll mounted with a tube in a hanging-down state.

In this respect, at the end portion of the aluminum tube as the core material of the charged roll, there was provided an electrode which rotationally contacts, and lead wire was drawn out and was connected to variable DC power supply through a voltmeter 4*a*.

This charged roll and a photosensitive drum 3 (OPC drum, the photosensitive surface of which is coated with a thin layer of polycarbonate film) are arranged at locations shown in FIG. 1. As regards setting of a clearance between roll and drum, voltage of 1.5 KV is applied from the variable DC power supply, a tube mounted to the charged roll in a hanging-down state is attracted to the photosensitive drum by electrostatic forces of attraction, and is set to a position (clearance) where contact is made at contact width of 3 to 5 mm for installation. (The clearance set in this way was about 1 mm)

In this respect, in this apparatus, the charged roll adopted the free rotating mechanism, and was arranged to rotate in synchronization with the rotation of the photosensitive drum.

In order to evaluate the charge shift/transfer capability of the charged roll-photosensitive drum in a charged roller type electrophotographic copying apparatus set in this way, the potential at which the drum was charged was measured under the following measurement conditions. That is, In order to evaluate the charging capability of the photosensitive drum, an exposure device 5, a developer unit 6 and a transfer roll 7 are stopped, the photosensitive drum 3 was caused to rotate at surface speed of 24 mm/second, voltage of 1.5 KV was applied from a variable DC power supply 4, and it was confirmed that the tube of a piezoelectric roll was attracted and in contact with the photosensitive drum at contact width of 3 to 5 mm. Thereafter, the potential at the photosensitive drum was measured with a voltmeter.

The measuring result was that the charging potential at the commencement of applied voltage, i.e., at the start of charging was 470 to 480 V, and the charging potential after continuous operation for five hours was 470 to 480 V, and it could be confirmed that the charged roll-photosensitive drum of this apparatus had stable charge shift/transfer capability.

Next, the copying performance evaluation for this apparatus was conducted under the following conditions:

As a copying original, a dot image (A4) of 100 lines 90% was used, the functions of the exposure device 5, the developer unit 6 (toner black) and the transfer drum 7 which were stopped in the previous test were returned to become operable, the photosensitive drum 3 was caused to rotate at the same applied voltage and operating speed as in the previous test, copying paper 8 (A4) was supplied, and a continuous copying test was conducted to conduct an image quality test for copied images.

First, 18,000 sheets of continuous copying was conducted at room temperature of 20° C. and at RH 45% as the copying environmental condition, and $100^{th}$, $5{,}000^{th}$, $10{,}000^{th}$, and $15{,}000^{th}$ copying samples were drawn out to conduct image quality check such as dot reproduction fidelity and density.

A comparison test for image quality evaluation was conducted with the original and the $100^{th}$ copying sample as comparison reference, and as a result, all the spot samples had the same image quality in terms of dot reproduction fidelity, density and the like, and satisfactory results were confirmed.

In order to check the influence of the copying environment on the copying apparatus, the continuous copying test up to $18{,}000^{th}$ sheet was terminated in the foregoing test. The copying environment was changed to room temperature of 40° C. and 80%, continuous copying of 2,000 sheets was conducted in the same way, and this $2{,}000^{th}$ copied sample was sampled to compare in image quality with the reference samples (original and the $100^{th}$ copied sample) in the previous image quality evaluation test. The evaluation test result was that they had the same image quality in terms of dot reproduction fidelity, density and the like, and it was confirmed that copying could be conducted without the copying performance being affected even under the environmental conditions of high temperature and high humidity.

The copying apparatus was stopped, the power supply was turned off, the charging roll was taken out, the charging tube 1 was pulled out from a guide roll 2 comprising an aluminum tube wound with a conductive sponge, and the surface state of the tube was observed using a microscope to check the charging tube 1 for a damaged state (presence or absence of surface roughness, a crack trace or the like) caused by high voltage applied. No abnormalities were observed, but the external dimension was 10 mmϕ and no changes were found.

Further, the surface resistance value was measured again, but its resistance value was $2(\pm 0.2)\times 10^7$ Ω/□, remained the same as before the test, and it was confirmed that any damage due to the running test was not caused.

As a result, it was confirmed that this copying apparatus was an excellent copying apparatus capable of withstanding continuous operations without being affected by variations with time, and conducting stable copying in high image quality in operating environment operable in practical use.

First Comparative Example

Except that the content of acetylene black of the polyamide elastomer tube for a charged roll of the first embodiment was changed to 4 wt. % and 31 wt. % to manufacture tubes for a charged roll (that is, the surface resistance value of the tube for the charged roll was changed), the effect of the surface resistance value of the charged roll on the copying performance was studied and evaluated under exactly the same conditions. The measurement results for the surface resistance values of the respective tubes for the charged roll manufactured were $10^2$ Ω/□ for the tube for the charged roll (hereinafter, referred to as ratio 4%) having acetylene black content of 4 wt. %, and $10^{14}$ Ω/□ for the tube for the charged roll (hereinafter, referred to as ratio 31%) changed to 31 wt. % in the same way.

In the [ratio 31%] tube, its surface state was somewhat rough seemingly probably because the amount of added acetylene black was too much.

When the charge shift/transfer capability of the charged roll-photosensitive drum was evaluated using this comparison sample as in the case of the first embodiment, in the case of the charged roll using the [ratio 4%] tube, the necessary charging potential could not be obtained on the photosensitive drum at 50 to 100V, but slight heat generation was observed. On the other hand, in the case of the charged roll using the [ratio 31%] tube, the predetermined charging potential was obtained, but there was roughness on the surface, the charging potential was uneven in places probably because of lack of smoothness, and uniform charged state could not be secured.

In a charged roll using the [ratio 4%] tube or [ratio 31%] tube in this way, only the charge shift/transfer capability of the charged roll-photosensitive drum as described above could be obtained, and no copying test was conducted because it was not worth being conducted.

Second Embodiment

By using the same polyether polyamide resin powder [produced by Ube Industries, Ltd. UBE PAE 1200S] as used in the first embodiment, changing only the amount of addition and compounding of acetylene black to 17 wt. %, performing mixing, kneading and pelletizing in the same way, using the same extruder as in the first embodiment, and changing only the spinning-taking off condition, there was obtained a tube 11 of polyether polyamide for the charged roll having an outside diameter of 15 mmϕ and thickness of 83μ.

When this tube was cut into a length of 380 mm to measure the surface resistance value, its resistance value was $5(\pm 0.5)\times 10^7$ Ω/□, and the tube had a stable and uniform resistance value in which no actual difference could be found even if the applied voltage was changed, and even if the measuring place was changed.

This tube 11 cut into a length of 330 mm was inserted into a guide roll having an outside diameter of 14.5 mmϕ, a length of 330 mm and surface hardness (Shore A35) wound with conductive sponge rubber on the outer periphery thereof with an aluminum tube as the core material for being heated, and was fitted into the guide roll of the core material for adhering to manufacture a charged roll. Thus, a charged roller type electrophotographic copying apparatus of such specification as shown in FIG. 2 was assembled, was adjusted and set such that the contact pressure between the charged roll and the photosensitive drum of the apparatus became a contact width of 3 to 5 mm to conduct the performance evaluation test as in the case of the first embodiment. In this respect, in this apparatus, the charged roll adopted the free rotating mechanism, and was arranged to rotate in synchronization with the rotation of the photosensitive drum.

The evaluation result for the charge shift/transfer capability of the charged roll-photosensitive drum was that the charging potential at the commencement of applied voltage, i.e., at the start of charging was 478 to 487 V, and the charging potential after continuous operation for five hours was 475 to 490 V, and it was shown that the charged roll-photosensitive drum of this apparatus had stable charge shift/transfer capability.

Subsequently, a copying performance test was conducted on the same conditions as in the first embodiment. However, in the test for this embodiment, four pinholes having the depth of 10$\mu$ and the size of 100$\mu$ were provided side by side at the central portion of the photosensitive drum 3.

As regards the test result under atmosphere of 20° C. and RH45%, all the spot samples had the same image quality in terms of dot reproduction fidelity, density and the like, and satisfactory results were confirmed. Image defects caused by those four pinholes provided on the photosensitive drum could not be detected.

Also, the test result under atmosphere of 40° C. and RH80% as the environmental conditions of high temperature and high humidity had no problems, but it was confirmed that copying could be conducted without the copying performance being affected by the copying environment.

Second Comparative Example

The copying performance in cases of two conditions where only the contact width of the charged roll-photosensitive drum in the second embodiment was changed to 0.9 to 1.2 mm and 8.5 to 9 mm were examined under atmosphere of 20° C. and RH45%.

The performance evaluation result was, in the case of contact width of 0.9 to 1.2 mm, somewhat inferior in fidelity and sharpness of image to the cases of the first and second embodiments, and the pinholes provided on the photosensitive drum were copied in a faint light black color.

In the case of contact width of 8.5 to 9 mm, the resolution of an image somewhat deteriorated with about 15,000$^{th}$ copied sheet, black density was entirely sensed low and lightly on the 20,000$^{th}$ copied sheet, and it was shown that in either case, the contact width between the charged roll and the photosensitive drum was improper and the copying performance was defective as compared with the second embodiment.

As regards the surface resistance value in the foregoing performance evaluation, electrodes were provided at both ends of a test piece sheet, were connected to a resistance measuring equipment "Hiresta" manufactured by Mitsubishi Petrochemical Co., Ltd. through a lead wire, and voltage was applied thereto with the voltage varied to 100, 250, and 500V (DC) to measure the resistance value at ten measuring points. These measured values were averaged into a surface resistivity value.

Effect of the Invention

The prevent invention has the following effects because of the structure described above:

In a charged roller type electrophotographic copying apparatus, polyamide elastomer, which has excellent charging performance, good charge shift/transfer efficiency, and appropriate hardness/flexural modulus/and compressive elasticity, has been adopted for the charged roll, whereby it becomes possible to execute contact between a charged roll and photosensitive drum in surface-contact having low contact pressure, resulting in an increase in durability of the apparatus and stable operation over a long term.

Since the surface resistance value of the charged roll can be stably maintained and the charge shift/transfer efficiency between charged roll and photosensitive drum is good, it becomes possible to copy with sharp images in stable, high fidelity over a long term.

Since charge shift/transfer onto the photosensitive drum is performed in surface-contact between the charged roll and the photosensitive drum, the amount of ozone evolution during operation (copying) is greatly reduced to noticeably improve the degree of environmental pollution.

Even if pinholes are provided on the surface of the photosensitive drum, the occurrence of image defects has been reduced.

What is claimed is:

1. A charged roller type electrophotographic copying apparatus, said charged roller being endless tubular film of polyamide elastomer having a surface resistance value of $10^3$ to $10^{13}$ Ω/□, and being provided so that it comes into surface-contact with a photoreceptor at its contact width therewith of 1.5 to 7 mm during copying.

2. The charged roller type electrophotographic copying apparatus according to claim 1, wherein the endless tubular film of said polyamide elastomer is a charged roller hung down from a conductive roller comprising a metallic core roller wound with conductive foam.

3. The charged roller type electrophotographic copying apparatus according to claim 1 or 2, wherein the endless tubular film of said polyamide elastomer contains 5 to 30 wt. % of carbon black.

4. The charged roller type electrophotographic copying apparatus according to claim 1, wherein the endless tubular film of said polyamide elastomer is polyether block amide elastomer mainly composed of segment consisting of nylon 12 segment and polyalkylene glycol.

5. The charged roller type electrophotographic copying apparatus according to claim 2, wherein the endless tubular film of said polyamide elastomer is polyether block amide elastomer mainly composed of segment consisting of nylon 12 segment and polyalkylene glycol.

6. The charged roller type electrophotographic copying apparatus according to claim 3, wherein the endless tubular film of said polyamide elastomer is polyether block amide elastomer mainly composed of segment consisting of nylon 12 segment and polyalkylene glycol.

* * * * *